US010336593B2

(12) United States Patent
Graham

(10) Patent No.: US 10,336,593 B2
(45) Date of Patent: Jul. 2, 2019

(54) JACK OPERATED TOILET LIFTING DEVICE

(71) Applicant: Randall Graham, Ottawa, IL (US)

(72) Inventor: Randall Graham, Ottawa, IL (US)

( * ) Notice: Subject to any disclaimer, the term of this patent is extended or adjusted under 35 U.S.C. 154(b) by 518 days.

(21) Appl. No.: 15/058,558

(22) Filed: Mar. 2, 2016

(65) Prior Publication Data

US 2016/0257537 A1 Sep. 8, 2016

Related U.S. Application Data

(60) Provisional application No. 62/176,961, filed on Mar. 2, 2015.

(51) Int. Cl.

| | |
|---|---|
| ***B66F 9/065*** | (2006.01) |
| ***B66C 1/18*** | (2006.01) |
| ***B66C 23/48*** | (2006.01) |
| *E03D 9/00* | (2006.01) |

(52) U.S. Cl.

CPC ..... *B66F 9/065* (2013.01); *B66C 1/18* (2013.01); *B66C 23/48* (2013.01); *E03D 9/00* (2013.01)

(58) Field of Classification Search

CPC ..... B66C 1/12; B66C 23/48; B66F 9/065
USPC ..... 269/17; 254/4 R, 134, 8 B; 212/901
See application file for complete search history.

(56) References Cited

U.S. PATENT DOCUMENTS 2,747,652 A * 5/1956 Marsh ..... A61G 7/1017 254/93 R
2,814,394 A * 11/1957 Witcher ..... B66C 23/48 254/124
3,059,785 A * 10/1962 Buckeye ..... B66C 23/48 212/261
3,185,422 A * 5/1965 Spindler ..... B66C 23/48 248/125.1
3,275,296 A * 9/1966 Meyer ..... B66C 23/48 212/261
3,367,512 A * 2/1968 Kaplan ..... B66C 23/48 212/294
3,391,905 A * 7/1968 Burns ..... B62B 3/0625 212/901
4,669,703 A * 6/1987 Hawkins ..... B66C 23/48 254/124
4,722,511 A * 2/1988 Chitwood ..... B62B 3/0625 254/134
5,082,127 A * 1/1992 Huang ..... B66C 23/48 212/181
5,203,065 A * 4/1993 Peters ..... B25H 1/00 254/2 R
5,261,640 A * 11/1993 Yuan ..... B66C 23/48 254/8 B (Continued)

FOREIGN PATENT DOCUMENTS

EP 1243545 A2 * 9/2002 ..... B66C 23/48

*Primary Examiner* — Ruth Ilan

(74) *Attorney, Agent, or Firm* — Donald Flaynik

(57) ABSTRACT

A device for lifting a toilet includes a base frame member disposed adjacent to a toilet (not part of the invention) such that the toilet can be elevated to a predetermined distance. The device further includes a substantially vertical elevation member secured to the base frame via a horizontal offset member integrally joined to the base frame, a lifting arm secured to the elevation member, a lifting member or strap assembly secure to the lifting arm, and a manually operated jack secured upon the horizontal offset member.

15 Claims, 5 Drawing Sheets

(56) References Cited

U.S. PATENT DOCUMENTS

| | | | | |
|---|---|---|---|---|
| 5,897,101 | A * | 4/1999 | Snyder | B66C 23/48 254/8 B |
| 6,457,700 | B1 * | 10/2002 | Hong | B66C 23/48 254/124 |
| 6,685,170 | B1 * | 2/2004 | Gwynn | B66C 5/025 254/325 |
| 7,134,151 | B1 * | 11/2006 | Cheramie | B62B 3/10 4/661 |
| 9,302,892 | B1 * | 4/2016 | Summit | B66F 9/18 |
| 2003/0071003 | A1 * | 4/2003 | Eaton | B66C 23/48 212/199 |
| 2007/0069490 | A1 * | 3/2007 | Japuntich | A61B 50/13 280/47.35 |
| 2007/0256238 | A1 * | 11/2007 | Wakil | B62B 3/0643 4/661 |
| 2007/0266492 | A1 * | 11/2007 | Junca | B62B 3/0643 4/661 |
| 2012/0112146 | A1 * | 5/2012 | Zhou | B66C 23/48 254/8 B |
| 2014/0339483 | A1 * | 11/2014 | Herb | B62B 3/02 254/2 C |

* cited by examiner

JACK OPERATED TOILET LIFTING DEVICE

BACKGROUND OF THE INVENTION

1. Field of the Invention

The present invention relates generally to a toilet lifting device, and more particularly, to a jack operated toilet lifting device that allows one person to vertically elevate and lower a toilet to prevent the toilet from damaging adjacent walls and/or cabinets, and to promote insertion of vertically disposed retaining screws through receiving apertures in the base of the toilet to ultimately secure a base portion of the toilet to a floor surface, such that a wax ring seals an interface gap between a sewer pipe and a discharge aperture in the bottom of the toilet.

2. Background of the Prior Art

Prior art toilet lifting devices require more than one person to operate. Further, prior art toilet lifting devices angularly elevate and lower a toilet relative to a floor surface, resulting in the misalignment between retaining screws that ultimately secure the toilet to the floor surface and apertures in the base of the toilet. Also, the angular position of the toilet relative to the floor surface can misalign a wax sealing ring with the discharge aperture in the bottom of the toilet and a sewer pipe, thereby allowing sewer gas to seep through the base of the toilet. Further, prior art toilet lifting devices do not include castors that enable one person to maneuver the toilet lifting device while supporting a toilet into relatively "tight" space where the toilet is ultimately lowered and secured upon a floor portion via the retaining screws.

A toilet lifting device is required that allows one person to elevate and lower a toilet relative to a floor surface such that a bottom wall of a base portion of the toilet remains substantially parallel with the floor surface, irrespective of the toilet being elevated above or lowered upon the floor surface. A further requirement is that the toilet lifting device be maneuverable in any direction such that minimal manual force need be imparted upon the device to manipulate the device and the supported toilet into a relatively small space where the toilet will be positioned.

SUMMARY OF THE INVENTION

A principal object of the present invention is to provide a jack operated toilet lifting device for enabling one person to vertically elevate a toilet above or vertically lower a toilet upon a floor surface. A feature of the device is a manually operated jack disposed to elevate a lifting arm supporting a lifting member that support and lifts a toilet. Another feature of the device is a vertical elevation member that cooperates with the lifting arm to position the lifting arm at a predetermined elevation above a floor surface. Still another feature of the device is a plurality of castors secured to a bottom portion of a frame to enable movement of the device upon a floor surface. An advantage of the device is that one person operates the jack. Another advantage of the device is that the lifting member maintains a bottom wall of a base portion of the toilet substantially parallel with the floor surface during the lowering or elevating of the toilet relative to the floor surface to promote axially alignment between retaining screws and apertures in a base portion of the toilet. Yet another advantage is that the person operating the device can select an elevation for the lifting arm to ultimately position the lifting member and the supported toilet at an elevation above the floor surface that enables the device, while supporting the toilet, to be manually disposed in any space dimensioned to receive the toilet.

Another object of the present invention is to maintain the position of the jack operated toilet lifting device relative to a sewer pipe. A feature of the device is locking castors that maintain the position of the device, while supporting a toilet, upon a floor surface such that when the toilet is lowered upon the floor surface, a discharge aperture in the bottom of the toilet and a wax ring are axially aligned with the sewer pipe. An advantage of the device is that when the base of the toilet engages the floor surface, the wax ring seals a gap between the sewer pipe and discharge aperture, thereby preventing sewer gas from seeping through the base of the toilet and causing a health hazard in the room where the toilet is located.

Briefly, the invention provides a jack operated toilet lifting device that includes a base frame disposed adjacent to a toilet such that the toilet can be elevated a predetermined distance; a substantially vertical elevation member secured to the base frame; a lifting arm secured to the elevation member, the lifting arm being disposed above the toilet at a predetermined elevation; a lifting member secured to the lifting arm, the lifting member ultimately supporting the toilet a predetermined distance above a floor portion; and an elevating member for elevating the lifting arm a distance that separates the toilet from the floor portion a predetermined distance, whereby the toilet lifting device is disposed relative to a toilet such that the toilet can be elevated to allow a seal to be inserted in a conduit that ultimately receives a discharge from the toilet.

Further, the invention provides a toilet lifting device that includes a base frame disposed adjacent to a toilet such that the toilet can be elevated a predetermined distance; a substantially vertical elevation member secured to the base frame; a lifting arm detachably secured to the elevation member, the lifting arm having a horizontal bar with a plurality of apertures disposed above the toilet a predetermined elevation; a substantially horizontal jack lifting member secured to a vertical portion of the lifting arm, the jack lifting member ultimately supporting the toilet a predetermined distance above a floor portion; and a member for forcibly elevating said jack lifting member a distance that correspondingly elevates the toilet above the floor portion a predetermined distance.

Also, the invention provides a lifting device that includes a base frame; an elevation member secured to the base frame; a lifting arm detachably secured to the elevation member, the lifting arm having a horizontal portion disposed above a predetermined object a predetermined elevation; a substantially horizontal jack lifting member secured to a vertical portion of the lifting arm, the jack lifting member ultimately supporting the predetermined object a predetermined distance above a floor portion; and a member for forcibly elevating the jack lifting member a distance that correspondingly elevates the predetermined object a predetermined distance.

BRIEF DESCRIPTION OF THE DRAWINGS

Objects, advantages and novel features of the present invention, as well as details of an illustrative embodiment thereof, will be understood from the following detailed description and attached drawings, wherein.

DESCRIPTION OF THE PREFERRED EMBODIMENT

Figure 1:
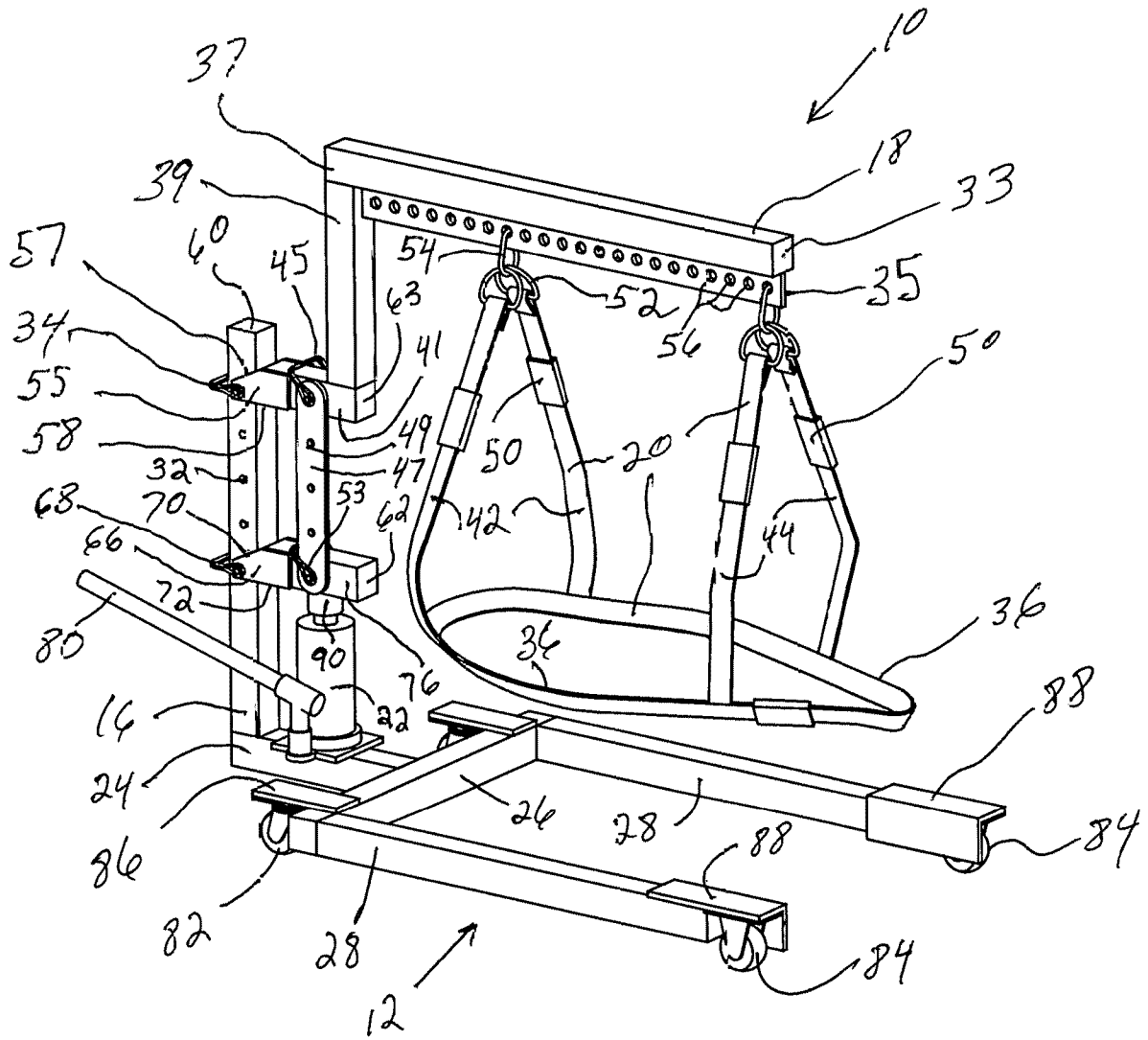
FIG. 1 is a perspective view of a toilet lifting device in accordance with the present invention.
Figure 2:
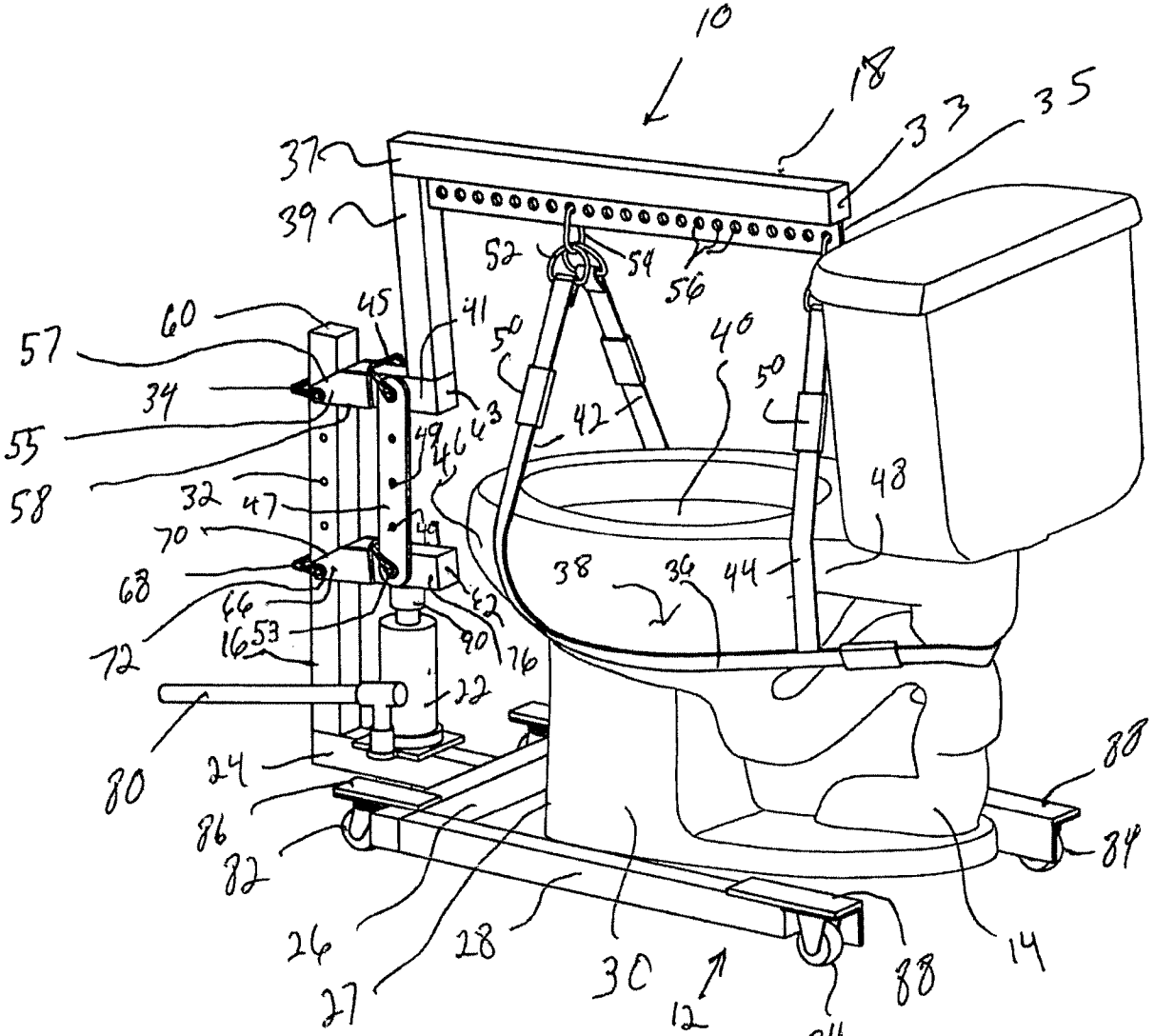
FIG. 2 is a perspective view of the toilet lifting device of FIG. 1, but with a toilet attached to and supported by the device in accordance with the present invention.
Figure 3:
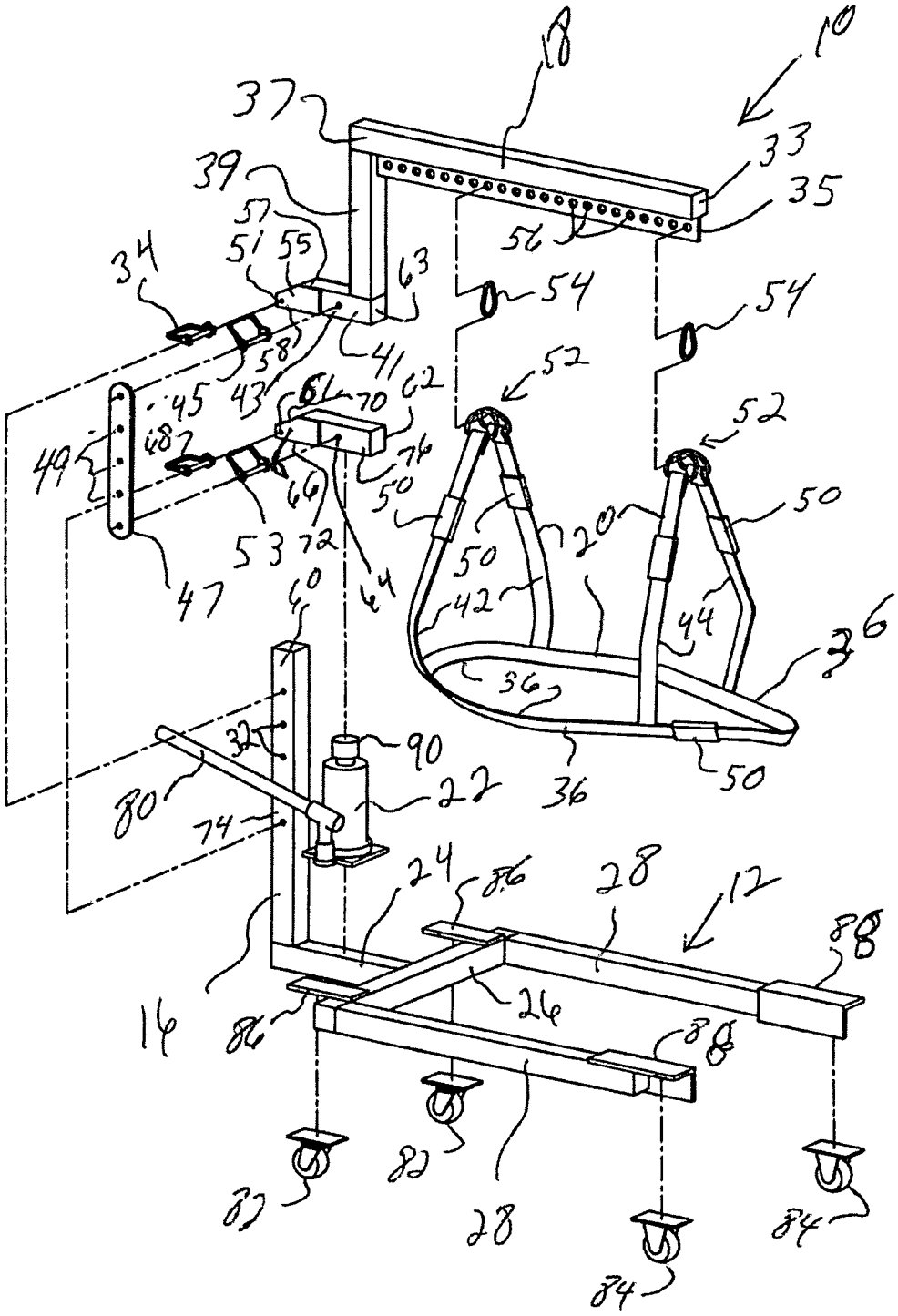
FIG. 3 is an exploded perspective view of the toilet lifting device of FIG. 1.

Referring now to the drawings, a toilet lifting device is depicted in accordance with the present invention as numeral 10. The device 10 includes a base frame member 12 disposed adjacent to a toilet 14 (not part of the invention) such that the toilet 14 can be elevated to a predetermined distance, a substantially vertical elevation member 16 secured to the base frame 12 via a horizontal offset member 24 integrally joined to the base frame 12, a lifting arm 18 secured to the elevation member 16, a lifting member or strap assembly 20 secure to the lifting arm 18, and a manually operated jack 22 secured upon the horizontal offset member 24.

The base frame 12 is fabricated from one and one-half inch square tube steel having substantially about a one-sixteenth inch wall thickness to provide sufficient strength to elevate and support the toilet 14. The base frame 12 includes a substantially "U" shaped configuration having dimensions that allows the base frame 12 to be disposed about the toilet 14 such that a front member 26 of said base frame 12 is disposed adjacent to a front portion 27 of the toilet 14, and substantially parallel side members 28 are disposed adjacent to opposite side portions 30 of the toilet 14. The preferred longitudinal dimension of the front member 26 is substantially about eighteen inches, and the preferred longitudinal dimension of the side members 28 is also substantially about eighteen inches.

The elevation member 16 is fabricated from one and one-half inch square steel channel having substantially about a one-sixteenth inch wall thickness to provide sufficient strength to elevate and support the toilet 14. The elevation member 16 is integrally secured to the horizontal offset member 24 via welding or similar securing means thereby rigidly joining the elevation member 16, offset member 24 and base frame 12 together to stabilize the toilet 14 when elevated from a floor portion (not depicted) and to offset the elevation member 16 from the toilet 14 to allow the jack 22 to be disposed between the elevation member 16 and the toilet 14 to reduce the torque or moment generated by the weight of the toilet 14 upon the elevation member 16 when the toilet 14 is supported by the lifting arm 18. The elevation member 16 further includes a plurality of vertically aligned apertures 32, one of the apertures ultimately being selected for receiving a retaining bolt 34 to pivotally secure the lifting arm 18 to the elevation member 16 via a lower horizontal member 41.

The lifting arm 18 is substantially about eighteen inches long and fabricated from the one and one-half inch square tube steel used for the elevation member 16. The lifting arm 18 includes a top horizontal portion 33 integrally and longitudinally joined to an edge portion of a steel flat bar 35 having a plurality of horizontally aligned apertures 56 therethrough that ultimately supports the strap assembly 20 that lifts and supports the toilet 14. The flat bar 35 is substantially about 18 inches long, one and one-half inches laterally and one-eighth inch thick. The lifting arm 18 is integrally joined via a first end 37 to a vertical member 39, which has a lower end integrally secured to the lower horizontal member 41. The lower horizontal member 41 includes a first aperture 43 that ultimately receives a retaining bolt 45 for securing a top portion of a steel lift bar 47 to the lower portion 41. The lower member 41 further includes a second aperture 51 through a pivot end 55 that ultimately receives the retaining bolt 34 that pivotally secures the lower portion 41 to the elevation member 16 via an upper aperture 32. The pivot end 55 includes an inclined top portion with the corresponding portion of the top and bottom walls 57 and 58 removed to allow the elevation member 16 to be vertically inserted through the lower member 41 such that a top portion 60 of the elevation member 16 is exposed and the lower member 41 is allowed to pivot from a first position, where the pivot end 55 is higher in elevation than a second end 63 of the lower member 41, to a second position where the pivot end 55 is at substantially the same elevation as the second end 63.

The lift bar 47 is substantially about nine inches in length, one and one-half inches laterally and one-quarter inch thick and includes a plurality of vertically aligned apertures 49. The lift bar 47 includes a lower portion that is secured to a jack lift member 62 via a retaining bolt 53 inserted through a cooperating lower aperture 49 in the lift bar 47 and through the jack lift member 62 via a first aperture 64. The jack lift member 62 further includes a second aperture 61 through a pivot end 66 that ultimately receives a retaining bolt 68 that pivotally secures the jack lift member 62 to the elevation member 16 via a lower aperture 32. The pivot end 66 includes an inclined top portion with the corresponding portion of the top and bottom walls 70 and 72 removed to allow the elevation member 16 to be vertically inserted through the jack lift member 62 such that a lower portion 74 of the elevation member 16 inserts through the jack lift member 62 such that the lift member is allowed to pivot from a first position, where the pivot end 66 is higher in elevation than a second end 76 of the jack lift member 62, to a second position where the pivot end 66 is at substantially the same elevation as the second end 76. When the toilet 14 is elevated above the floor portion, a side elevation view of the device 10 will depict the lower member 41 and jack lift member 62 as always being parallel to each other irrespective of the position of the lifting jack 22 when a person lowers or lifts the jack handle 80.

The strap assembly 20 is fabricated from leather having substantially about a one inch lateral dimension and a one-quarter inch thickness. The strap assembly 20 includes an annular portion 36 with length adjustment buckles 50 that horizontally and snugly encircles a lower portion 38 of a toilet bowl 40 portion of the toilet 14. The strap assembly 20 also includes front and back loop portions 42 and 44 (also with length adjustments buckles 50) are integrally joined to cooperating portions of the annular portion 36, and vertically grasp front and back portions 46 and 48 of the toilet bowl 40 as the front and back portions 46 and 48 extend upward to ultimately be secured to the lifting arm 18 via two metal end loops 52 secured to corresponding ends of the front and back loop portions 42 and 44, and via one metal loop 54 detachably secured to respective end loops 52 of each loop portion 42 and 44. Each of the metal loops 54 is ultimately detachably secured to the lifting arm 18 via one of a plurality of horizontally aligned apertures 56 in the lifting arm 18 such that the predetermined aperture 56 results in each of the front and back loop portions 42 and 44 of the strap assembly 20 being perpendicular to the lifting arm 18 when taking a side view of the device 10 when elevating and supporting the toilet 14 above a floor portion.

The manual movement of the base frame 12 upon the floor portion is achieved by swivel wheel castors 82 attached to predetermined bottom portions of the front member of the base frame 12, and straight wheel castors 84 attached to predetermined bottom portions of the side members 28 of the base frame 12. Alternatively, any number of swivel or straight wheel castors 82 and 84 can be used to achieve manual movement of the base frame 12. To increase the structural strength of the bottom portions of the base frame 12 that engage the wheel castors 82, reinforcing wheel plates may be welded to the bottom portions. The wheel plates dimensions would be substantially about four and one-half inches long, two inches wide and one-eighth of an inch thick. Irrespective of the castors 82 and 84 used to manually move the device 10, all castors will have manual locking and unlocking features that maintain the position of the device 10 relative to the toilet 14 when the toilet 14 is lifted above a floor portion, and when the toilet 14 is lowered back to its original position upon the floor portion. To increase the manual control of the positioning of the toilet lifting device 10 about the toilet 14, front and back wheel extension members 86 and 88 are attached to respective front and back portions of the base frame 12 such that cooperating castors wheels are attached to corresponding extension members 86 and 88.

In operation, a person required to replace the wax ring that seal a toilet 14 upon a discharge conduit (not depicted), positions the toilet lifting device 10 adjacent to the toilet 14, then secures the lifting arm 18 and the lifting bar 47 (via the horizontal lower portion 41 and lift member 62) to the elevation member 16 such that the annular portion 36 of the lifting member 20 is at an elevation above a floor portion that enables the annular portion 36 to ultimately engage a lower portion 38 of the toilet bowl 40. The "U" configured base frame 12 is "wheeled" to position the device 10 about the base of the toilet 14, thereby positioning the lifting arm 18 a predetermined distance above the toilet bowl 40 such that the lifting arm 18 is angled in a general downward direction above the bowl 40 and the lifting jack 22 is in a lowered position. The jack 22 includes substantially about a three inch maximum vertical lift and is well known to those of ordinary skill in the art. An annular portion of a strap assembly 20 is snugly wrapped about a lower portion 38 of the toilet bowl 40, and front and back loop portions 42 and 44 are wrapped about corresponding front and back portions 46 and 48 of the toilet bowl 40.

The front and back loop portions 42 and 44 are then connected to a lifting arm 18 such that slack in the loop portions 42 and 44 is minimized, and the swivel and straight wheel castors 82 and 84 are locked to secure the position of the device 10 relative to the toilet 14. The jack handle 80 is then depressed and the jack cylinder 90 is then urged upward to engage a grease lubricated bottom portion of the jack lift member 62, the grease reducing friction between the bottom portion of the jack lift member 62 as the bottom portion slides a small distance upon the jack cylinder 90 during the elevating of the toilet 14. The jack lift member 62 is pivotally urged upward and in turn urges the lower horizontal member 41 pivotally upward via the lift bar 47 until the lower horizontal member 41, lift bar 47 and lifting arm 18 are substantially horizontal. The horizontal positioning of the lifting arm 18 elevates the toilet 14 a distance above the floor portion that allows the person to replace a defective wax ring or to do other maintenance. If the elevated toilet 14 obstructs the person from accessing the targeted floor area, the person can easily move the toilet to a new position by unlocking the castors 82 and 84, then manually urging the device 10 and the elevated toilet 14 to a new position upon the floor portion.

Upon competing the required work, the person can easily move the elevated toilet 14 back to its original position, then lower the jack handle 80 to retract the jack cylinder 90 which in turn lowers the lower horizontal member 41, which correspondingly lowers the lift bar 47 and lifting arm 18, resulting in the toilet 14 being reset to its original position upon the floor portion.

Figure 4:
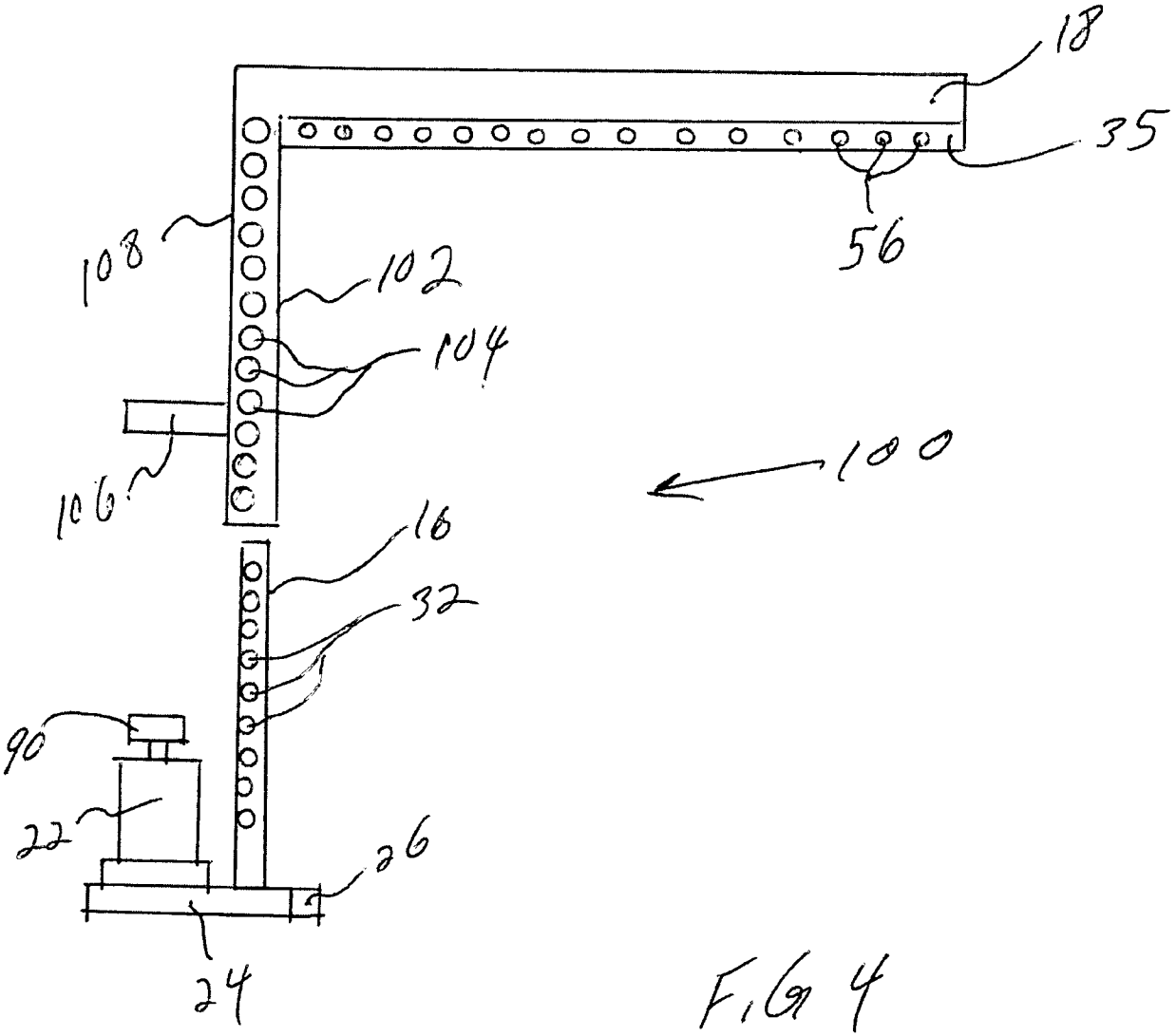
FIG. 4 is a side elevation view of a modified toilet lifting device with a vertical portion separated from an elevation member in accordance with the present invention.
Figure 5:
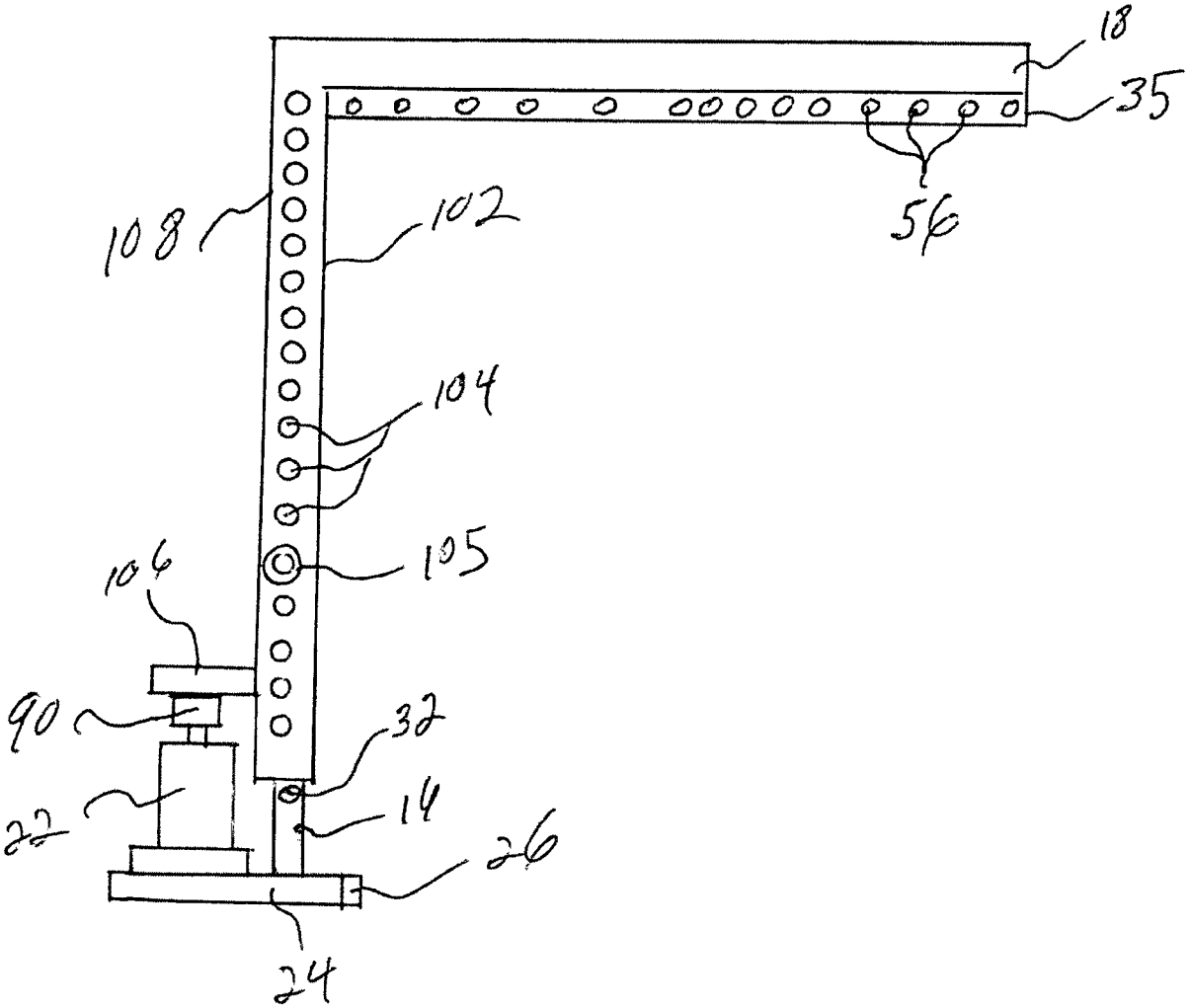
FIG. 5 is the side elevation of FIG. 4 but with the vertical portion substantially covering the elevation member in accordance with the present invention.

Referring now to FIGS. 4 and 5, side elevation views of a modified configuration of the toilet lifting device 10 is depicted as numeral 100. The lifting member 20, base frame 12 and jack handle 80 of the device 10 are also part of the modified configuration 100, but are not include in FIGS. 4 and 5. The modified configuration 100 includes the lifting arm 18 with a vertical portion 102 having a relatively longer longitudinal dimension when compared to the vertical portion 39 of the toilet lifting device 10. The longitudinal dimension of the vertical portion 102 is longer than the longitudinal dimension of the elevation member 16, thereby allowing the vertical portion 102 to substantially cover the elevation member 16 when the vertical portion 102 is snugly slid, via grease or similar lubrication, upon the elevation member 16 until covering the elevation member 16.

The vertical portion 102 includes a plurality of vertically aligned apertures 104 with one of the apertures 104 ultimately receive a retaining bolt 105 (FIG. 5) that inserts through the one predetermined aperture 104 and through a cooperating aperture 32 in the elevation member 16 after the jack 22 has elevated the toilet 14 above a floor portion via the jack cylinder 90 engaging and elevating a horizontal jack lift member 106 integrally joined to an outer wall 108 of the vertical portion 102. The insertion of the retaining bolt through cooperating apertures 104 and 32 in the vertical portion 102 and elevation member 16, prevents injury to the person and damage to the toilet 14 in the event that the jack 22 should fail, which would result in a relatively fast lowering of the vertical portion 102 over the elevation member 16, which correspondingly causes the elevated toilet 14 supported by the lifting arm 18 to impact the floor portion with great force.

The invention claimed is:

1. A jack operated toilet lifting device comprising:

a base frame adapted to be disposed adjacent to a toilet such that the toilet can be elevated a predetermined distance;

a substantially vertical elevation member secured to said base frame;

a lifting arm secured to said elevation member, said lifting arm adapted to be disposed above the toilet at a predetermined elevation;

a lifting member secured to said lifting arm, said lifting member adapted to support the toilet a predetermined distance above a floor portion, said lifting member including a strap assembly secured to said lifting arm, said strap assembly having an annular portion disposed about a bowl portion of the toilet and at least one support portion having lower ends joined to said annular portion and upper ends joined to said lifting arm; and a manually operated jack for elevating said lifting arm a distance that separates the toilet from the floor portion a predetermined distance, whereby said toilet lifting device is adapted to be disposed relative to a toilet such that said toilet lifting device can elevate the toilet to allow a seal to be inserted in a conduit that ultimately receives a discharge from the toilet.

2. The toilet lifting device of claim 1 wherein said base frame includes means for promoting the manual movement of said base frame upon a floor portion.

3. The toilet lifting device of claim 2 wherein said base frame includes a substantially "U" shaped configuration having dimensions that allows said base frame to be disposed about the toilet such that a front member of said base frame is disposed adjacent to a front portion of the toilet, and substantially parallel side members are disposed adjacent to opposite side portions of the toilet.

4. The toilet lifting device of claim 2 wherein said means for promoting the manual movement of said base frame upon a floor portion includes wheel castors attached to predetermined bottom portions of front and side members of said base frame.

5. The toilet lifting device of claim 2 wherein said means for promoting the manual movement of said base frame upon a floor portion includes lockable swivel wheel castors attached to a front portion of said base frame and straight wheel castors capable of only lineal movement attached to a back portion of said base frame.

6. The toilet lifting device of claim 2 wherein said means for promoting the manual movement of said base flame upon a floor portion includes wheel extension members attached to respective front and back portions of said base frame such that castor wheels are attached to corresponding wheel extension members to increase manual control of the positioning of said toilet lifting device about the toilet.

7. The toilet lifting device of claim 1 wherein said elevation member is integrally secured to said base frame via a horizontal offset member that horizontally offsets said elevation member from said base frame to prevent the toilet from obstructing the optimum positioning of said toilet lifting device relative to the toilet.

8. The toilet lifting device of claim 1 wherein said elevation member includes a plurality of apertures for receiving a retaining bolt to pivotally secure said lifting arm to said elevation member.

9. The toilet lifting device of claim 1 wherein said strap assembly includes at least two support portions each having lower ends joined to predetermined portions of said annular portion, and each support portion having upper ends joined to connecting rings inserted through cooperating apertures in said lifting arm.

10. The toilet lifting device of claim 1 wherein said manually operated jack is disposed upon said horizontal member between said elevation member and said base frame.

11. The toilet lifting device of claim 10 wherein said includes a lower horizontal member having a pivot end pivotally secured to an upper portion of said elevation member via a bolt member inserted through apertures in said pivot end of said lower horizontal member and through a cooperating aperture in said elevation member.

12. The toilet lifting device of claim 10 wherein said manually operated jack includes a lift member having a pivot end pivotally secured to a lower portion of said elevation member via a bolt member inserted through apertures in said pivot end of said lift member and through a cooperating aperture in said elevation member.

13. A jack operated toilet lifting device comprising:

a base frame adapted to be disposed adjacent to a toilet such that the toilet can be elevated a predetermined distance;

a substantially vertical elevation member secured to said base frame, said elevation member being integrally secured to said base frame via a horizontal offset member that horizontally offsets said elevation member from said base frame to prevent the toilet from obstructing the optimum positioning of said toilet lifting device relative to the toilet;

a lifting arm secured to said elevation member, said lifting arm adapted to be disposed above the toilet at a predetermined elevation;

a lifting member secured to said lifting arm, said lifting member adapted to support the toilet a predetermined distance above a floor portion; and a manually operated jack for elevating said lifting arm a distance that separates the toilet from the floor portion a predetermined distance, said manually operated jack being disposed upon said horizontal member between said elevation member and said base frame, said manually operated jack including a lower horizontal member having a pivot end pivotally secured to an upper portion of said elevation member via a bolt member inserted through apertures in said pivot end of said lower horizontal member and through a cooperating aperture in said elevation member, said manually operated jack including a lift bar member having an upper end pivotally secured to said lower horizontal member, said lift bar member having a lower end pivotally secured to a jack lift member via a bolt member inserted through apertures in said jack lift member and through a cooperating aperture in said lift bar member, said jack lift member having a first end pivotally secured to a lower portion of said elevation member via a bolt member inserted through apertures in said first end of said jack lift member and through a cooperating aperture in said elevation member; whereby said toilet lifting device is adapted to be disposed relative to a toilet such that said toilet lifting device can elevate the toilet to allow a seal to be inserted in a conduit that ultimately receives a discharge from the toilet.

14. A jack operated toilet lifting device comprising:

a base frame adapted to be disposed adjacent to a toilet such that the toilet can be elevated a predetermined distance;

a substantially vertical elevation member secured to said base frame;

a lifting arm secured to said elevation member, said lifting arm adapted to be disposed above the toilet at a predetermined elevation;

a lifting member secured to said lifting arm, said lifting member adapted to support the assembly secured to said lifting arm via at least one connecting ring inserted through a toilet a predetermined distance above a floor portion, said lifting member including a strap cooperating aperture in said lifting arm, said strap assembly having an annular portion disposed about a bowl portion of the toilet and at least one support portion having lower ends joined to said annular portion and upper ends joined to said connecting ring inserted through said operating aperture in said lifting arm; and a manually operated jack for elevating said lifting arm a distance that separates the toilet from the floor portion a predetermined distance, whereby said toilet lifting device is adapted to be disposed relative to a toilet such that said toilet lifting device can elevate the toilet to allow a seal to be inserted in a conduit that ultimately receives a discharge from the toilet.

15. The toilet lifting device of claim 14 wherein said strap assembly includes at least two support portions each having lower ends joined to predetermined portions of said annular portion, and each support portion having upper ends joined to connecting rings inserted through cooperating apertures in said lifting arm.

* * * * *